United States Patent [19]

Suonvieri

[11] 4,265,362

[45] May 5, 1981

[54] DEVICE FOR RELEASABLY HOLDING RELATIVELY SLIM ARTICLES

[76] Inventor: Elaine Suonvieri, 3rd Ave. & Hickory Sts., Floodwood, Minn. 55736

[21] Appl. No.: 46,649

[22] Filed: Jun. 8, 1979

[51] Int. Cl.[3] ..... A47F 7/00

[52] U.S. Cl. ..... 211/60 R

[58] Field of Search ..... 211/60 R, 120, 69.1, 211/89; 15/159 A, 164, 206; 47/41 SS, 41.12, 41.13

[56] References Cited

U.S. PATENT DOCUMENTS

| | | | |
|---|---|---|---|
| 2,049,365 | 7/1936 | Follett | 15/164 |
| 2,121,307 | 6/1938 | Swift | 211/89 |
| 2,128,011 | 8/1938 | Morgan | 47/41.13 X |
| 3,451,723 | 6/1969 | Marks | 15/164 X |

FOREIGN PATENT DOCUMENTS

| | | | |
|---|---|---|---|
| 327532 | 7/1935 | Italy | 211/89 |

*Primary Examiner*—James T. McCall
*Assistant Examiner*—Robert W. Gibson, Jr.
*Attorney, Agent, or Firm*—Wicks & Nemer

[57] ABSTRACT

A device for releasably holding relatively slim articles including a multiplicity of segments banded together in a cluster, each segment including a twisted wire core engaging between the twists thereof a multiplicity of bristles extending radially from the core. The bristles of one segment engage within the bristles of another segment for frictional engagement with an article inserted between the bristles.

1 Claim, 4 Drawing Figures

DEVICE FOR RELEASABLY HOLDING RELATIVELY SLIM ARTICLES

SUMMARY

The invention relates to an improvement in a device for releasably holding with insertion random substantially elongated articles such as pencils scissors and the like.

It is an object of the invention to provide a device having a multiplicity of segments banded together to form a cluster, each segment including a twisted wire core engaging between the twists thereof a multiplicity of bristles extending radially from the core. The segments are banded together whereby the bristles of the segments engage bristles of other segments. An article such as a pencil is pushed into the bristles without any particular direction whereby the pencil is firmly and releasably held by frictional engagement with the bristles.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
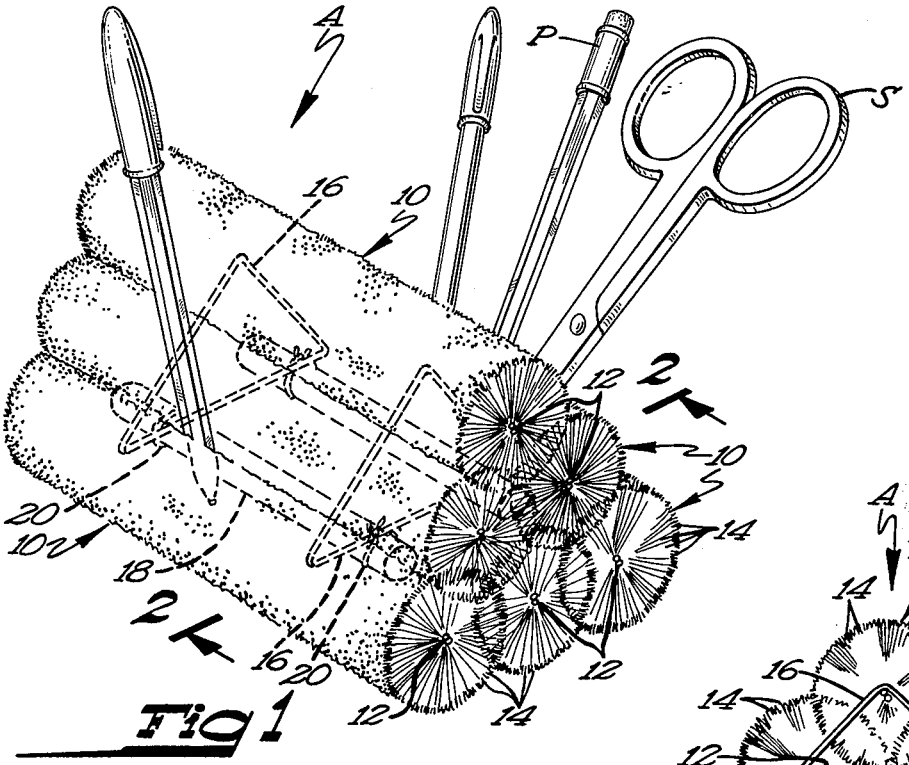
FIG. 1 is a perspective view of a device for releasably holding relatively slim articles and embodying the invention with articles shown as held thereby.

Referring to the drawings in detail, the device A for releasably holding relatively slim articles includes a plurality of segments 10 closely grouped together as hereinafter described.

A segment 10 includes a length of twisted wire core 12. As the two lengths of wire making up the core are twisted the same are twisted about lengths of bristles 14 centrally thereof whereby the bristles extend radially from the core. The above construction results in a cylindrical shape formation segment 10.

The segments 10 are grouped together in a cluster by aligning the cores 12 of at least three segments and pressing the segments together with the bristles of one segment extended within and in engagement with the bristles of another segment all of which tends to hold the segments together and in alignment one with the other. The segments are firmly held together by a series of spaced bands 16 drawn up tightly upon the cores 12 where the segments are held together in a cluster as shown in the Figures of the drawings. The bands 16 may be rubber bands, cord or wire secured together at the ends.

Figure 2:
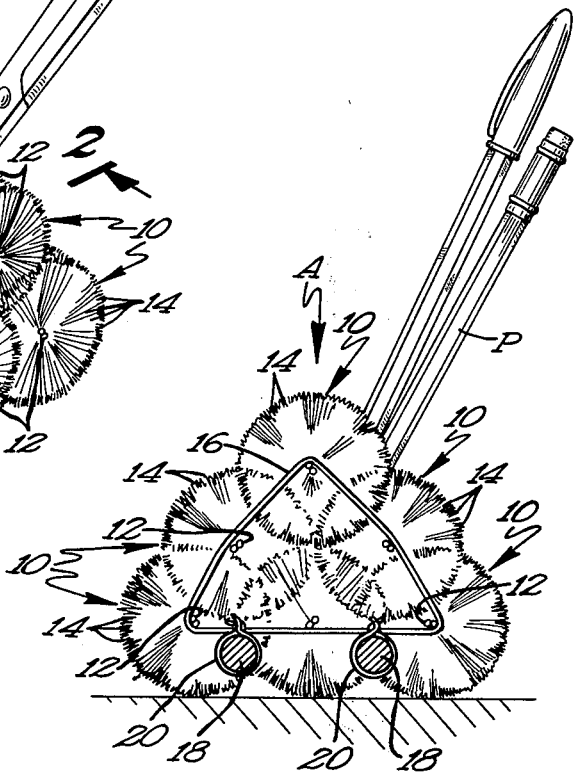
FIG. 2 is a sectional view on the line 2—2 of FIG. 1.
Figure 3:
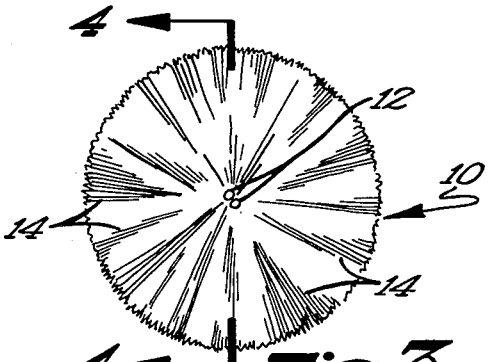
FIG. 3 is an end view of one of the segments of the device.
Figure 4:
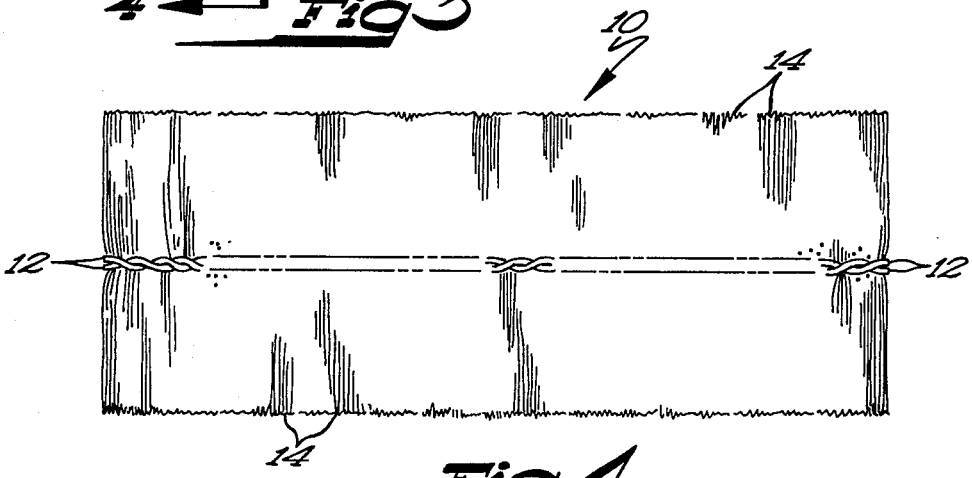
FIG. 4 is a longitudinal side view that shown in FIG. 3.

With the segments bound and held together in units of three a base is formed by two of the segments and upon which the device A rests particularly as illustrated in FIG. 2. Elongated weight members 18 are secured to the bands 16 by wires 20 whereby the device A resists movement when an article is inserted into the same.

In use of the device A a pencil such as P is easily inserted into the bristles where it is grippingly held against a forceful displacement. Other items such as scissors S may be easily inserted into the unit whereby the same is held as illustrated in FIG. 1.

Having thus described the invention, what is claimed as new and desired to be secured by Letters Patent is:

1. A device for releasably holding relatively slim articles comprising in combination:

(a) at least three elongated segments any two of which forms a base, each segment including a multiplicity of bristles extending radially, from (b) an elongated axial core with the bristles of each segment in overlapping interengagement with the bristles of each of the other segments in triangular formations and (c) means holding said segments together including at least one band secured about the cores of the segments normal to the longitudinal axis of the cores.

* * * * *